US009484044B1

(12) United States Patent
Mascaro et al.

(10) Patent No.: US 9,484,044 B1
(45) Date of Patent: Nov. 1, 2016

(54) VOICE ENHANCEMENT AND/OR SPEECH FEATURES EXTRACTION ON NOISY AUDIO SIGNALS USING SUCCESSIVELY REFINED TRANSFORMS

(71) Applicant: THE INTELLISIS CORPORATION, San Diego, CA (US)

(72) Inventors: Massimo Mascaro, San Diego, CA (US); David C. Bradley, La Jolla, CA (US)

(73) Assignee: KnuEdge Incorporated, San Diego, CA (US)

( * ) Notice: Subject to any disclaimer, the term of this patent is extended or adjusted under 35 U.S.C. 154(b) by 0 days.

(21) Appl. No.: 13/944,750

(22) Filed: Jul. 17, 2013

(51) Int. Cl.
*G10L 21/0232* (2013.01)

(52) U.S. Cl.
CPC ..... *G10L 21/0232* (2013.01)

(58) Field of Classification Search
CPC ..... G10L 25/90; G10L 2025/906; G10L 2025/903; G10L 25/78; G10L 2025/783; G10L 2025/786
See application file for complete search history.

(56) References Cited

U.S. PATENT DOCUMENTS

| | | | | |
|---|---|---|---|---|
| 5,774,837 | A * | 6/1998 | Yeldener et al. | 704/208 |
| 5,815,580 | A | 9/1998 | Craven et al. | 381/58 |
| 5,978,824 | A | 11/1999 | Ikeda | |
| 6,195,632 | B1 | 2/2001 | Pearson | |
| 6,594,585 | B1 | 7/2003 | Gersztenkorn | |
| 7,085,721 | B1 * | 8/2006 | Kawahara | G10L 25/90 704/205 |
| 7,117,149 | B1 | 10/2006 | Zakarauskas | 704/233 |
| 7,249,015 | B2 | 7/2007 | Jiang et al. | 704/222 |
| 7,389,230 | B1 | 6/2008 | Nelken | 704/255 |
| 7,664,640 | B2 | 2/2010 | Webber | 704/243 |
| 7,668,711 | B2 | 2/2010 | Chong et al. | 704/219 |

(Continued)

FOREIGN PATENT DOCUMENTS

| | | |
|---|---|---|
| WO | WO 2012/129255 | 9/2012 |
| WO | WO 2012/134991 | 10/2012 |
| WO | WO 2012/134993 | 10/2012 |

OTHER PUBLICATIONS

Saha, S.; Kay, S.M., "Maximum likelihood parameter estimation of superimposed chirps using Monte Carlo importance sampling," in Signal Processing, IEEE Transactions on , vol. 50, No. 2, pp. 224-230, Feb. 2002.*

(Continued)

*Primary Examiner* — Michael N Opsasnick
*Assistant Examiner* — Kee Young Lee
(74) *Attorney, Agent, or Firm* — Edell, Shapiro & Finnan, LLC

(57) ABSTRACT

Voice enhancement and/or speech features extraction may be performed on noisy audio signals using successively refined transforms. Downsampled versions of an input signal may be obtained, which include a first downsampled signal with a lower sampling rate than a second downsampled signal. Successive transforms may be performed on the input signal to obtain a corresponding sound model of the input signal. The successive transforms performed may include: (1) performing a first transform on the first downsampled signal to yield a first pitch estimate; (2) performing a second transform on the second downsampled signal to yield a second pitch estimate and a first harmonics estimate based on the first pitch estimate; and (3) performing a third transform on the input signal to yield a third pitch estimate and a second harmonics estimate based on the second pitch estimate and the first harmonics estimate.

18 Claims, 4 Drawing Sheets

(56) References Cited

U.S. PATENT DOCUMENTS

| | | | | |
|---|---|---|---|---|
| 8,015,002 | B2 | 9/2011 | Li et al. | |
| 2003/0177002 | A1* | 9/2003 | Chen | 704/207 |
| 2004/0066940 | A1 | 4/2004 | Amir | |
| 2004/0111266 | A1* | 6/2004 | Coorman et al. | 704/260 |
| 2004/0128130 | A1 | 7/2004 | Rose et al. | 704/236 |
| 2004/0158462 | A1 | 8/2004 | Rutledge et al. | |
| 2004/0167777 | A1 | 8/2004 | Hetherington et al. | |
| 2004/0176949 | A1 | 9/2004 | Wenndt et al. | 704/203 |
| 2004/0220475 | A1 | 11/2004 | Szabo et al. | 600/458 |
| 2005/0114128 | A1 | 5/2005 | Hetherington et al. | 704/233 |
| 2005/0149321 | A1 | 7/2005 | Kabi et al. | |
| 2006/0053003 | A1 | 3/2006 | Suzuki et al. | |
| 2006/0100866 | A1 | 5/2006 | Alewine et al. | 704/226 |
| 2006/0100868 | A1 | 5/2006 | Hetherington et al. | |
| 2006/0130637 | A1* | 6/2006 | Crebouw | G10L 19/0204 84/603 |
| 2006/0136203 | A1 | 6/2006 | Ichikawa | |
| 2007/0010997 | A1 | 1/2007 | Kim | 704/208 |
| 2008/0033585 | A1* | 2/2008 | Zopf | 700/94 |
| 2008/0052068 | A1* | 2/2008 | Aguilar et al. | 704/230 |
| 2008/0082323 | A1 | 4/2008 | Bai et al. | 704/214 |
| 2008/0262836 | A1 | 10/2008 | Goto | |
| 2008/0312913 | A1 | 12/2008 | Goto | |
| 2009/0012638 | A1 | 1/2009 | Lou | 700/94 |
| 2009/0016434 | A1* | 1/2009 | Amonou et al. | 375/240.12 |
| 2009/0076822 | A1* | 3/2009 | Sanjaume | G10L 19/093 704/268 |
| 2010/0131086 | A1 | 5/2010 | Itoyama | |
| 2010/0174534 | A1* | 7/2010 | Vos | 704/207 |
| 2010/0211384 | A1* | 8/2010 | Qi et al. | 704/207 |
| 2010/0260353 | A1 | 10/2010 | Ozawa | 381/94.3 |
| 2010/0299144 | A1 | 11/2010 | Barzelay et al. | |
| 2010/0332222 | A1 | 12/2010 | Bai et al. | 704/214 |
| 2011/0016077 | A1 | 1/2011 | Vasilache et al. | 706/52 |
| 2011/0060564 | A1 | 3/2011 | Hoge | 703/2 |
| 2011/0286618 | A1 | 11/2011 | Vandali et al. | 381/320 |
| 2012/0072209 | A1 | 3/2012 | Krishnan | |
| 2012/0191450 | A1 | 7/2012 | Pinson | |
| 2012/0243694 | A1 | 9/2012 | Bradley et al. | 381/56 |
| 2012/0243705 | A1 | 9/2012 | Bradley et al. | 381/94.4 |
| 2012/0243707 | A1 | 9/2012 | Bradley et al. | 381/98 |
| 2013/0046533 | A1* | 2/2013 | Nyquist et al. | 704/207 |
| 2013/0158923 | A1* | 6/2013 | Stanton et al. | 702/76 |
| 2013/0165788 | A1* | 6/2013 | Osumi et al. | 600/443 |
| 2013/0255473 | A1 | 10/2013 | Abe et al. | |

OTHER PUBLICATIONS

Vargas-Rubio, J.G.; Santhanam, B., "An improved spectrogram using the multiangle centered discrete fractional Fourier transform," in Acoustics, Speech, and Signal Processing, 2005. Proceedings. (ICASSP '05). IEEE International Conference on , vol. 4, No., pp. iv/505-iv/508 vol. 4, Mar. 18-23, 2005.*

Pantazis, Y.; Rosec, O.; Stylianou, Y., "Chirp rate estimation of speech based on a time-varying quasi-harmonic model," in Acoustics, Speech and Signal Processing, 2009. ICASSP 2009. IEEE International Conference on , vol., No., pp. 3985-3988, Apr. 19-24, 2009.*

Luis Weruaga, Márian Képesi, The fan-chirp transform for non-stationary harmonic signals, Signal Processing, vol. 87, Issue 6, Jun. 2007, pp. 1504-1522, ISSN 0165-1684, http://dx.doi.org/10.1016/j.sigpro.2007.01.006. (http://www.sciencedirect.com/science/article/pii/S0165168407000114).*

Kumar et al., "Speaker Recognition Using GMM", *International Journal of Engineering Science and Technology*, vol. 2, No. 6, 2010, retrieved from the Internet: http://www.ijest.info/docs/IJEST10-02-06-112.pdf, pp. 2428-2436.

Kamath et al, "Independent Component Analysis for Audio Classification", *IEEE 11th Digital Signal Processing Workshop & IEEE Signal Processing Education Workshop*, 2004, retrieved from the Internet: http://2002.114.89.42/resource/pdf/1412.pdf, pp. 352-355.

Vargas-Rubio et al., "An Improved Spectrogram Using the Multiangle Centered Discrete Fractional Fourier Transform", *Proceedings of International Conference on Acoustics, Speech, and Signal Processing*, Philadelphia, 2005, retrieved from the internet: <URL: http://www.ece.unm.edu/faculty/beanthan/PUB/ICASSP-05-JUAN.pdf>, 4 pages.

U.S. Appl. No. 13/945,731, filed Jul. 18, 2013, 33 pages.

U.S. Appl. No. 13/945,731 Office Action dated Jan. 1, 2015 , citing prior art, 12 pages.

U.S. Appl. No. 13/961,811 Office Action dated Apr. 20, 2015 citing prior art, 9 pages.

U.S. Appl. No. 13/961,811, filed Aug. 7, 2013, 30 pages.

* cited by examiner

VOICE ENHANCEMENT AND/OR SPEECH FEATURES EXTRACTION ON NOISY AUDIO SIGNALS USING SUCCESSIVELY REFINED TRANSFORMS

FIELD OF THE DISCLOSURE

This disclosure relates to performing voice enhancement on noisy audio signals using successively refined transforms.

BACKGROUND

Systems configured to identify speech in an audio signal are known. Existing systems, however, typically may waste processing resources on portions of the audio signal that do not contain vocalized speech.

SUMMARY

One aspect of the disclosure relates to a system configured to perform voice enhancement and/or speech features extraction on noisy audio signals, in accordance with one or more implementations. Voice enhancement and/or speech features extraction may be performed on noisy audio signals using successively refined transforms. Exemplary implementations may reduce computing resources spent on portions of the audio signal that do not contain vocalized speech. Downsampled versions of an input signal may be obtained, which include a first downsampled signal with a lower sampling rate than a second downsampled signal. Successive transforms may be performed on the input signal to obtain a corresponding, increasingly refined, sound model of the input signal. The successive transforms performed may include: (1) performing a first transform on the first downsampled signal to yield a first pitch estimate; (2) performing a second transform on the second downsampled signal to yield a second pitch estimate and a first harmonics estimate based on the first pitch estimate; and (3) performing a third transform on the input signal to yield a third pitch estimate and a second harmonics estimate based on the second pitch estimate and the first harmonics estimate.

The communications platform may be configured to execute computer program modules. The computer program modules may include one or more of an input module, a preprocessing module, a downsampling module, one or more extraction modules, a reconstruction module, an output module, and/or other modules.

The input module may be configured to receive an input signal from a source. The input signal may include human speech (or some other wanted signal) and noise. The waveforms associated with the speech and noise may be superimposed in input signal.

The preprocessing module may be configured to segment the input signal into discrete successive time windows. A given time window may span a duration greater than a sampling interval of the input signal.

The downsampling module may be configured to obtain downsampled versions of the input signal. The downsampled versions of the input signal may include a first downsampled signal, a second downsampled signal, and/or other downsampled signals. The downsampled signals may have different sampling rates. For example, the first downsampled signal may have a first sampling rate, while the second downsampled signal may have a second sampling rate. The first sampling rate may be less than the second sampling rate.

Generally speaking, the extraction module(s) may be configured to extract harmonic information from the input signal. The extraction module(s) may include one or more of a transform module, a vocalized speech module, a formant model module, and/or other modules.

The transform module may be configured to obtain a sound model over individual time windows of the input signal. In some implementations, the transform module may be configured to obtain a linear fit in time of a sound model over individual time windows of the input signal. A sound model may be described as a mathematical representation of harmonics in an audio signal. A harmonic may be described as a component frequency of the audio signal that is an integer multiple of the fundamental frequency (i.e., the lowest frequency of a periodic waveform or pseudo-periodic waveform). That is, if the fundamental frequency is f, then harmonics have frequencies $2f$, $3f$, $4f$, etc.

The transform module may be configured to perform successive transforms with increasing levels of accuracy associated with individual time windows of the input signal to obtain corresponding sound models of input signal in the individual time windows. Each successive transform may be performed on a version of the input signal having an increased sampling rate compared to the previous transform. That is, an initial transform may be performed on a downsampled signal having a lowest sampling rate, the next transform may be performed on a downsampled signal having a sampling rate that is greater than the lowest sampling rate, and so on until the last transform, which may be performed on the input signal at the full sampling rate (i.e., the sampling rate at which the input signal was received). Each of the successive transforms may yield a pitch estimate and/or a harmonics estimate. A given harmonics estimate may convey amplitude and phase information associated with individual harmonics of the speech component of the input signal. A pitch estimate and/or a harmonics estimate from a previous transform may be used with a given transform as one or more of input to the given transform, parameters of the given transform, and/or metrics to determine a pitch estimate and/or a harmonics estimate associated with the given transform.

In some implementations, the successive transforms performed to obtain a first sound model corresponding to a first time window of the input signal may comprise: (1) performing a first transform on the first time window of the first downsampled signal to yield a first pitch estimate; (2) performing a second transform on the first time window of the second downsampled signal to yield a second pitch estimate and a first harmonics estimate based on the first pitch estimate; and (3) performing a third transform on the first time window of the input signal to yield a third pitch estimate and a second harmonics estimate based on the second pitch estimate and the first harmonics estimate. The first sound model may comprise the third pitch estimate and the second harmonics estimate. In some implementations, the first transform, second transform, and third transform may be the same or similar. According to some implementations, the first transform may be different from the second transform, the second transform may be different from the third transform, and/or the third transform may be different from the first transform. In particular, the transforms may be performed with increasing time and/or frequency resolution.

The vocalized speech module may be configured to determine probabilities that portions of the speech component represented by the input signal in the individual time windows are vocalized portions or non-vocalized portions. Successive transforms performed by the transform module may be performed only on portions having a threshold probability of being a vocalized portion. For example, a portion of the second downsampled signal may be transformed responsive to a corresponding portion of the first downsampled signal being determined to have a threshold-breaching probability of being a vocalized portion. A portion of the input signal may be transformed responsive to a corresponding portion of the second downsampled signal being determined to have a threshold-breaching probability of being a vocalized portion.

The formant model module may be configured to model harmonic amplitudes based on a formant model. Generally speaking, a formant may be described as the spectral resonance peaks of the sound spectrum of the voice. One formant model—the source-filter model—postulates that vocalization in humans occurs via an initial periodic signal produced by the glottis (i.e., the source), which is then modulated by resonances in the vocal and nasal cavities (i.e., the filter).

The reconstruction module may be configured to reconstruct the speech component of the input signal with the noise component of the input signal being suppressed. The reconstruction may be performed once each of the parameters of the formant model has been determined. The reconstruction may be performed by interpolating all the time-dependent parameters and then resynthesizing the waveform of the speech component of the input signal.

The output module may be configured to transmit an output signal to a destination. The output signal may include the reconstructed speech component of the input signal.

These and other features, and characteristics of the present technology, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and in the claims, the singular form of "a", "an", and "the" include plural referents unless the context clearly dictates otherwise.

DETAILED DESCRIPTION

Voice enhancement and/or speech feature extraction may be performed on noisy audio signals using successively refined transforms. Exemplary implementations may reduce computing resources spent on portions of the audio signal that do not contain vocalized speech. Downsampled versions of an input signal may be obtained, which include a first downsampled signal with a lower sampling rate than a second downsampled signal. Successive transforms may be performed on the input signal to obtain a corresponding, increasingly refined, sound model of the input signal. The successive transforms performed may include: (1) performing a first transform on the first downsampled signal to yield a first pitch estimate; (2) performing a second transform on the second downsampled signal to yield a second pitch estimate and a first harmonics estimate based on the first pitch estimate; and (3) performing a third transform on the input signal to yield a third pitch estimate and a second harmonics estimate based on the second pitch estimate and the first harmonics estimate.

Figure 1:
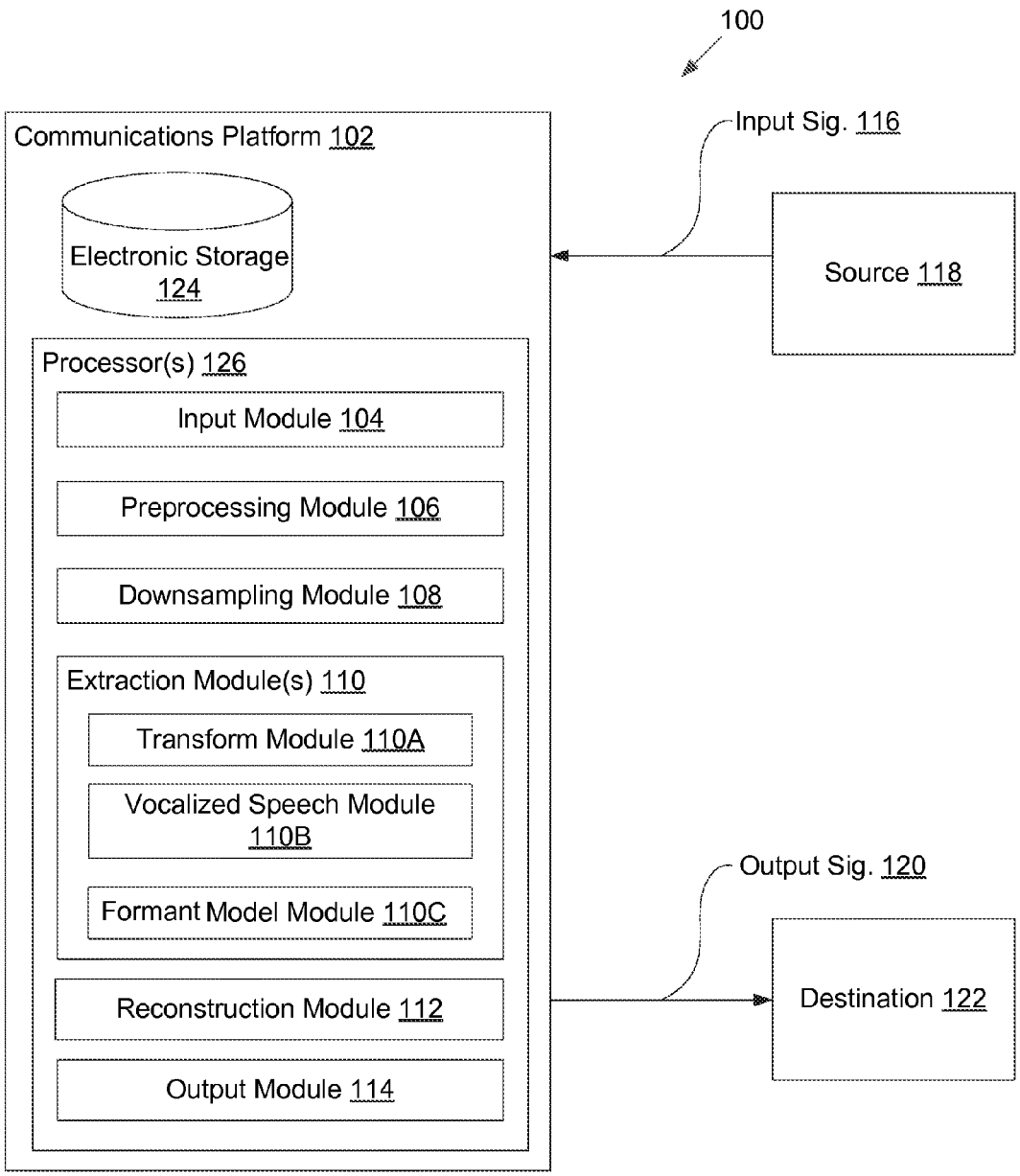
FIG. 1 illustrates a system configured to perform voice enhancement and/or speech features extraction on noisy audio signals, in accordance with one or more implementations.

FIG. 1 illustrates a system 100 configured to perform voice enhancement and/or speech features extraction on noisy audio signals, in accordance with one or more implementations. Voice enhancement may be also referred to as de-noising or voice cleaning. As depicted in FIG. 1, system 100 may include a communications platform 102 and/or other components. Generally speaking, a noisy audio signal containing speech may be received by communications platform 102. The communications platform 102 may extract harmonic information from the noisy audio signal. The harmonic information may be used to reconstruct speech contained in the noisy audio signal. By way of non-limiting example, communications platform 102 may include a mobile communications device such as a smart phone, according to some implementations. Other types of communications platforms are contemplated by the disclosure, as described further herein.

The communications platform 102 may be configured to execute computer program modules. The computer program modules may include one or more of an input module 104, a preprocessing module 106, a downsampling module 108, one or more extraction modules 110, a reconstruction module 112, an output module 114, and/or other modules.

The input module 104 may be configured to receive an input signal 116 from a source 118. The input signal 116 may include human speech (or some other wanted signal) and noise. The waveforms associated with the speech and noise may be superimposed in input signal 116. The input signal 116 may include a single channel (i.e., mono), two channels (i.e., stereo), and/or multiple channels. The input signal 116 may be digitized.

Speech is the vocal form of human communication. Speech is based upon the syntactic combination of lexicals and names that are drawn from very large vocabularies (usually in the range of about 10,000 different words). Each spoken word is created out of the phonetic combination of a limited set of vowel and consonant speech sound units. Normal speech is produced with pulmonary pressure provided by the lungs which creates phonation in the glottis in the larynx that is then modified by the vocal tract into different vowels and consonants. Various differences among vocabularies, syntax that structures individual vocabularies, sets of speech sound units associated with individual vocabularies, and/or other differences create the existence of many thousands of different types of mutually unintelligible human languages.

The noise included in input signal 116 may include any sound information other than a primary speaker's voice. The noise included in input signal 116 may include structured noise and/or unstructured noise. A classic example of structured noise may be a background scene where there are multiple voices, such as a café or a car environment. Unstructured noise may be described as noise with a broad spectral density distribution. Examples of unstructured noise may include white noise, pink noise, and/or other unstructured noise. White noise is a random signal with a flat power spectral density. Pink noise is a signal with a power spectral density that is inversely proportional to the frequency.

Figure 2:
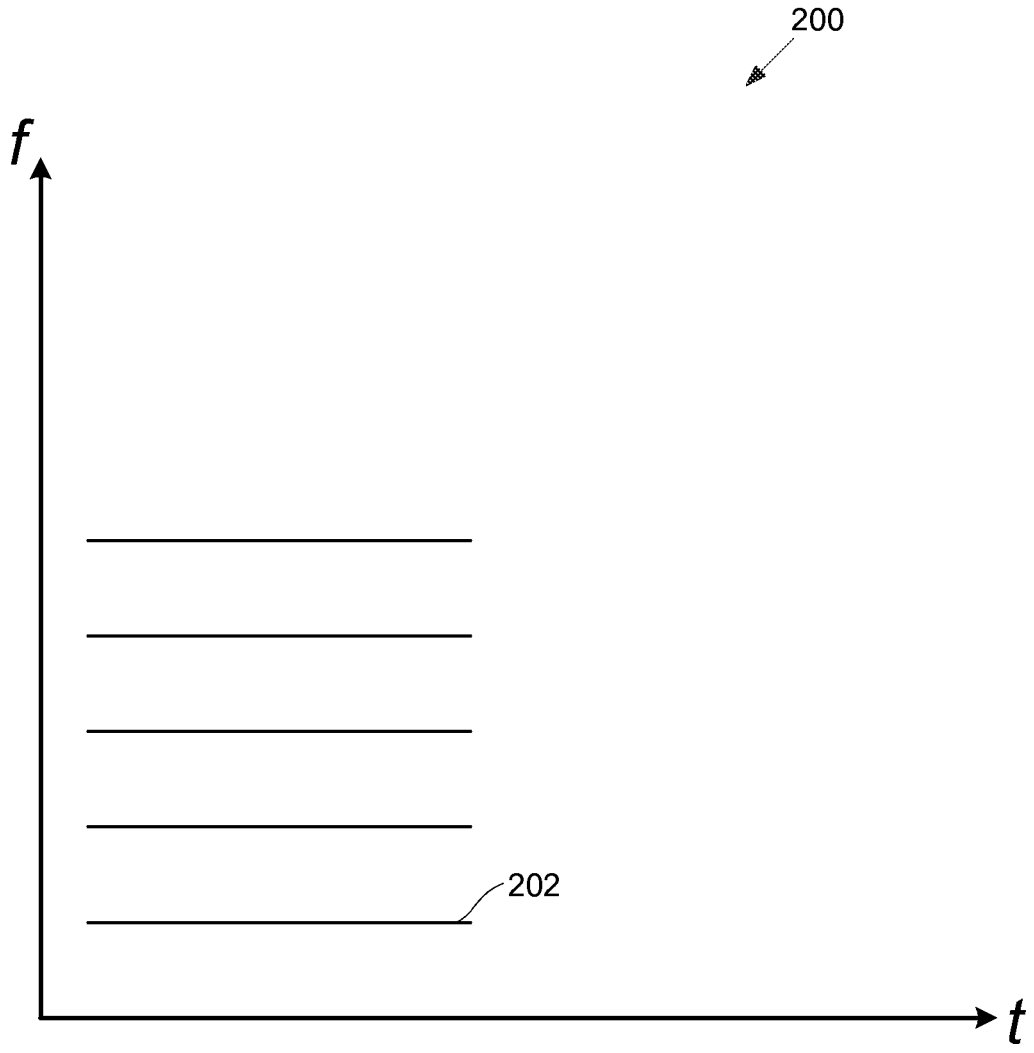
FIG. 2 illustrates an exemplary spectrogram, in accordance with one or more implementations.

An audio signal, such as input signal 116, may be visualized by way of a spectrogram. A spectrogram is a time-varying spectral representation that shows how the spectral density of a signal varies with time. Spectrograms may be referred to as spectral waterfalls, sonograms, voiceprints, and/or voicegrams. Spectrograms may be used to identify phonetic sounds. FIG. 2 illustrates an exemplary spectrogram 200, in accordance with one or more implementations. In spectrogram 200, the horizontal axis represents time (t) and the vertical axis represents frequency (f). A third dimension indicating the amplitude of a particular frequency at a particular time emerges out of the page. A trace of an amplitude peak as a function of time may delineate a harmonic in a signal visualized by a spectrogram (e.g., harmonic 202 in spectrogram 200). In some implementations, amplitude may be represented by the intensity or color of individual points in a spectrogram. In some implementations, a spectrogram may be represented by a 3-dimensional surface plot. The frequency and/or amplitude axes may be either linear or logarithmic, according to various implementations. An audio signal may be represented with a logarithmic amplitude axis (e.g., in decibels, or dB), and a linear frequency axis to emphasize harmonic relationships or a logarithmic frequency axis to emphasize musical, tonal relationships.

Referring again to FIG. 1, source 118 may include a microphone (i.e., an acoustic-to-electric transducer), a remote device, and/or other source of input signal 116. By way of non-limiting illustration, where communications platform 102 is a mobile communications device, a microphone integrated in the mobile communications device may provide input signal 116 by converting sound from a human speaker and/or sound from an environment of communications platform 102 into an electrical signal. As another illustration, input signal 116 may be provided to communications platform 102 from a remote device. The remote device may have its own microphone that converts sound from a human speaker and/or sound from an environment of the remote device. The remote device may be the same as or similar to communications platforms described herein.

The preprocessing module 106 may be configured to segment input signal 116 into discrete successive time windows. A given time window may span a duration greater than a sampling interval of input signal 116. According to some implementations, a given time window may have a duration in the range of 15-60 milliseconds. In some implementations, a given time window may have a duration that is shorter than 15 milliseconds or longer than 60 milliseconds. The individual time windows of segmented input signal 116 may have equal durations. In some implementations, the duration of individual time windows of segmented input signal 116 may be different. For example, the duration of a given time window of segmented input signal 116 may be based on the amount and/or complexity of audio information contained in the given time window such that the duration increases responsive to a lack of audio information or a presence of stable audio information (e.g., a constant tone).

The downsampling module 108 may be configured to obtain downsampled versions of input signal 116. Generally speaking, downsampling (or "subsampling") may refer to the process of reducing the sampling rate of a signal. Downsampling may be performed to reduce the data rate or the size of the data. A downsampling factor (commonly denoted by M) may be an integer or a rational fraction greater than unity. The downsampling factor may multiply the sampling time or, equivalently, may divide the sampling rate. According to various implementations, downsampling module 108 may perform a downsampling process on input signal 110 to obtain the downsampled signals, or downsampling module 108 may obtain the downsampled signals from another source.

The downsampled versions of input signal 116 may include a first downsampled signal, a second downsampled signal, and/or other downsampled signals. The downsampled signals may have different sampling rates. For example, the first downsampled signal may have a first sampling rate, while the second downsampled signal may have a second sampling rate. The first sampling rate may be less than the second sampling rate. The first sampling rate may be approximately half the second sampling rate. The first sampling rate may be about one eighth that of input signal 116. The second sampling rate may be about one fourth that of input signal 116. In some implementations, input signal 116 may have a sampling rate of 44.1 kHz. The first sampling rate may be about 5 kHz and the second sampling rate may be about 10 kHz. While exemplary sampling rates are disclosed above, this is not intended to be limiting as other sampling rates may be used and are within the scope of the disclosure.

Generally speaking, extraction module(s) 110 may be configured to extract harmonic information from input signal 116. The extraction module(s) 110 may include one or more of a transform module 110A, a vocalized speech module 110B, a formant model module 110C, and/or other modules.

The transform module 110A may be configured to obtain a sound model over individual time windows of input signal 116. In some implementations, transform module 110A may be configured to obtain a linear fit in time of a sound model over individual time windows of input signal 116. A sound model may be described as a mathematical representation of harmonics in an audio signal. A harmonic may be described as a component frequency of the audio signal that is an integer multiple of the fundamental frequency (i.e., the lowest frequency of a periodic waveform or pseudo-periodic waveform). That is, if the fundamental frequency is f, then harmonics have frequencies 2*f*, 3*f*, 4*f*, etc.

The transform module 110A may be configured to model input signal 116 as a superposition of harmonics that all share a common pitch and chirp. Such a model may be expressed as:

$$m(t)2\Re\left(\sum_{h=1}^{N_h} A_h e^{j2\pi h(\phi t+\frac{\chi\phi}{2}t^2)}\right), \quad \text{EQN. 1}$$

where $\phi$ is the base pitch and x is the fractional chirp rate $$(\chi = \frac{c}{\phi},$$

where c is the actual chirp), both assumed to be constant in a small time window. Pitch is defined as the rate of change of phase over time. Chirp is defined as the rate of change of pitch over time (i.e., the second time derivative of phase). The model of input signal 116 may be assumed as a superposition of $N_h$ harmonics with a linearly varying fundamental frequency. $A_h$ is a complex coefficient weighting all the different harmonics. Being complex, $A_h$ carries information about both the amplitude and about the phase at the center of the time window for each harmonic.

The model of input signal 116 as a function of $A_h$ may be linear, according to some implementations. In such implementations, linear regression may be used to fit the model, such as follows:

$$\sum_{h=1}^{N_h} A_h e^{j2\pi h(\phi t+\frac{\chi\phi}{2}t^2)} = M(\phi, \chi, t)\overline{A} \qquad \text{EQN. 2}$$

with, discretizing time as $(t_1, t_2, \ldots, t_{N_t})$:

$$M(\phi, \chi) = \begin{bmatrix} e^{j2\pi(\phi t_1+\frac{\chi\phi}{2}t_1^2)} & e^{j2\pi 2(\phi t_1+\frac{\chi\phi}{2}t_1^2)} & \ldots & e^{j2\pi N_h(\phi t_1+\frac{\chi\phi}{2}t_1^2)} \\ e^{j2\pi(\phi t_2+\frac{\chi\phi}{2}t_2^2)} & e^{j2\pi 2(\phi t_2+\frac{\chi\phi}{2}t_2^2)} & \ldots & e^{j2\pi N_h(\phi t_2+\frac{\chi\phi}{2}t_2^2)} \\ \vdots & \vdots & \ddots & \vdots \\ e^{j2\pi(\phi t_{N_t}+\frac{\chi\phi}{2}t_{N_t}^2)} & e^{j2\pi 2(\phi t_{N_t}+\frac{\chi\phi}{2}t_{N_t}^2)} & \ldots & e^{j2\pi N_h(\phi t_{N_t}+\frac{\chi\phi}{2}t_{N_t}^2)} \end{bmatrix}$$

$$\overline{A} = \begin{pmatrix} A_1 \\ \vdots \\ A_{N_h} \end{pmatrix}.$$

The best value for $\overline{A}$ may be solved via standard linear regression in discrete time, as follows:

$$\overline{A}=M(\phi,\chi)\backslash s, \qquad \text{EQN. 3}$$

where the symbol \ represents matrix left division (e.g., linear regression).

Due to input signal 116 being real, the fitted coefficients may be doubled with their complex conjugates as:

$$m(t) = (M(\phi, \chi)M^*(\phi, \chi))\begin{pmatrix} \overline{A} \\ \overline{A^*} \end{pmatrix}. \qquad \text{EQN. 4}$$

The optimal values of $\phi,\chi$ may not be determinable via linear regression. A nonlinear optimization step may be performed to determine the optimal values of $\phi,\chi$. Such a nonlinear optimization may include using the residual sum of squares as the optimization metric:

$$[\hat{\phi}, \chi] = \underset{\phi,\chi}{\operatorname{argmin}}\left[\sum_t (s(t) - m(t, \phi, \chi, \overline{A}))^2 \Big|_{\overline{A}=M(\phi,\chi)\backslash s}\right], \qquad \text{EQN. 5}$$

where the minimization is performed on $\phi,\chi$ at the value of $\overline{A}$ given by the linear regression for each value of the parameters being optimized.

The transform module 110A may be configured to impose continuity to different fits over time. That is, both continuity in the pitch estimation and continuity in the coefficients estimation may be imposed to extend the model set forth in EQN. 1. If the pitch becomes a continuous function of time (i.e., $\phi=\phi(t)$), then the chirp may be not needed because the fractional chirp may be determined by the derivative of $\phi(t)$ as $$\chi(t) = \frac{1}{\phi(t)}\frac{d\phi(t)}{dt}.$$

According to some implementations, the model set forth by EQN. 1 may be extended to accommodate a more general time dependent pitch as follows:

$$m(t) = \Re\left(\sum_{h=1}^{N_h} A_h(t)e^{j2\pi h\int_0^t \phi(\tau)d\tau}\right) = \Re\left(\sum_{h=1}^{N_h} A_h(t)e^{jh\Phi(t)}\right), \qquad \text{EQN. 6}$$

where $\Phi(t)=2\pi\int_0^t\phi(\tau)d\tau$ is integral phase.

According to model set forth in EQN. 6, the harmonic amplitudes $A_h(t)$ are time dependent. The harmonic amplitudes may be assumed to be piecewise linear in time such that linear regression may be invoked to obtain $A_h(t)$ for a given integral phase $\Phi(t)$:

$$A_h(t) = A_h(0) = \sum_i \Delta A_h^i \sigma\left(\frac{t - t^{i-1}}{t^i - t^{i-1}}\right), \qquad \text{EQN. 7}$$

where $$\sigma(t) = \begin{cases} 0 \text{ for } t < 0 \\ t \text{ for } 0 \le t \le 1 \\ 1 \text{ for } t > 1 \end{cases}$$

and $\Delta A_h^i$ are time-dependent harmonic coefficients. The time-dependent harmonic coefficients $\Delta A_h^i$ represent the variation on the complex amplitudes at times $t^i$.

EQN. 7 may be substituted into EQN. 6 to obtain a linear function of the time-dependent harmonic coefficients $\Delta A_h^i$. The time-dependent harmonic coefficients $\Delta A_h^i$ may be solved using standard linear regression for a given integral phase $\Phi(t)$. Actual amplitudes may be reconstructed by $$A_h^i = A_h^0 + \sum_1^i \Delta A_h^i.$$

The linear regression may be determined efficiently due to the fact that the correlation matrix of the model associated with EQN. 6 and EQN. 7 has a block Toeplitz structure, in accordance with some implementations.

A given integral phase $\Phi(t)$ may be optimized via nonlinear regression. Such a nonlinear regression may be performed using a metric similar to EQN. 5. In order to reduce the degrees of freedom, $\Phi(t)$ may be approximated with a number of time points across which to interpolate by $\Phi(t)$ $=\text{interp}(\Phi^1=\Phi(t^1), \Phi^2=\Phi(t^2), \ldots, \Phi^{N_t}=\Phi(t^{N_t}))$. In some implementations, the interpolation function may be cubic. The nonlinear optimization of the integral pitch may be:

$$[\Phi^1, \Phi^{N_t}, \ldots \Phi^{N_t}] = \qquad \text{EQN. 8}$$

-continued $$\underset{\Phi^1,\Phi^2,\ldots,\Phi^{N_t}}{\operatorname{argmin}}\left[\sum_t\left(s(t)-m\left(t,\Phi(t),\overline{A_h^t}\right)\right)^2\Bigg|_{\substack{\overline{A_h^t}=M(\Phi(t))\backslash s(t)\\ \Phi(t)=interp(\Phi^1,\Phi^2,\ldots,\Phi^{N_t})}}\right].$$

The different $\Phi^i$ may be optimized one at a time with multiple iterations across them. Because each $\Phi^i$ affects the integral phase only around $t^i$, the optimization may be performed locally, according to some implementations.

The transform module 110A may be configured to perform successive transforms with increasing levels of accuracy associated with individual time windows of the input signal to obtain corresponding sound models of input signal in the individual time windows. Each successive transform may be performed on a version of input signal 116 having an increased sampling rate compared to the previous transform. That is, an initial transform may be performed on a downsampled signal having a lowest sampling rate, the next transform may be performed on a downsampled signal having a sampling rate that is greater than the lowest sampling rate, and so on until the last transform, which may be performed on input signal 116 at the full sampling rate (i.e., the sampling rate at which input signal 116 was received). Each of the successive transforms may yield a pitch estimate and/or a harmonics estimate. A given harmonics estimate may convey amplitude and phase information associated with individual harmonics of the speech component of input signal 116. A pitch estimate and/or a harmonics estimate from a previous transform may be used with a given transform as one or more of input to the given transform, parameters of the given transform, and/or metrics to determine a pitch estimate and/or a harmonics estimate associated with the given transform.

Figure 3:
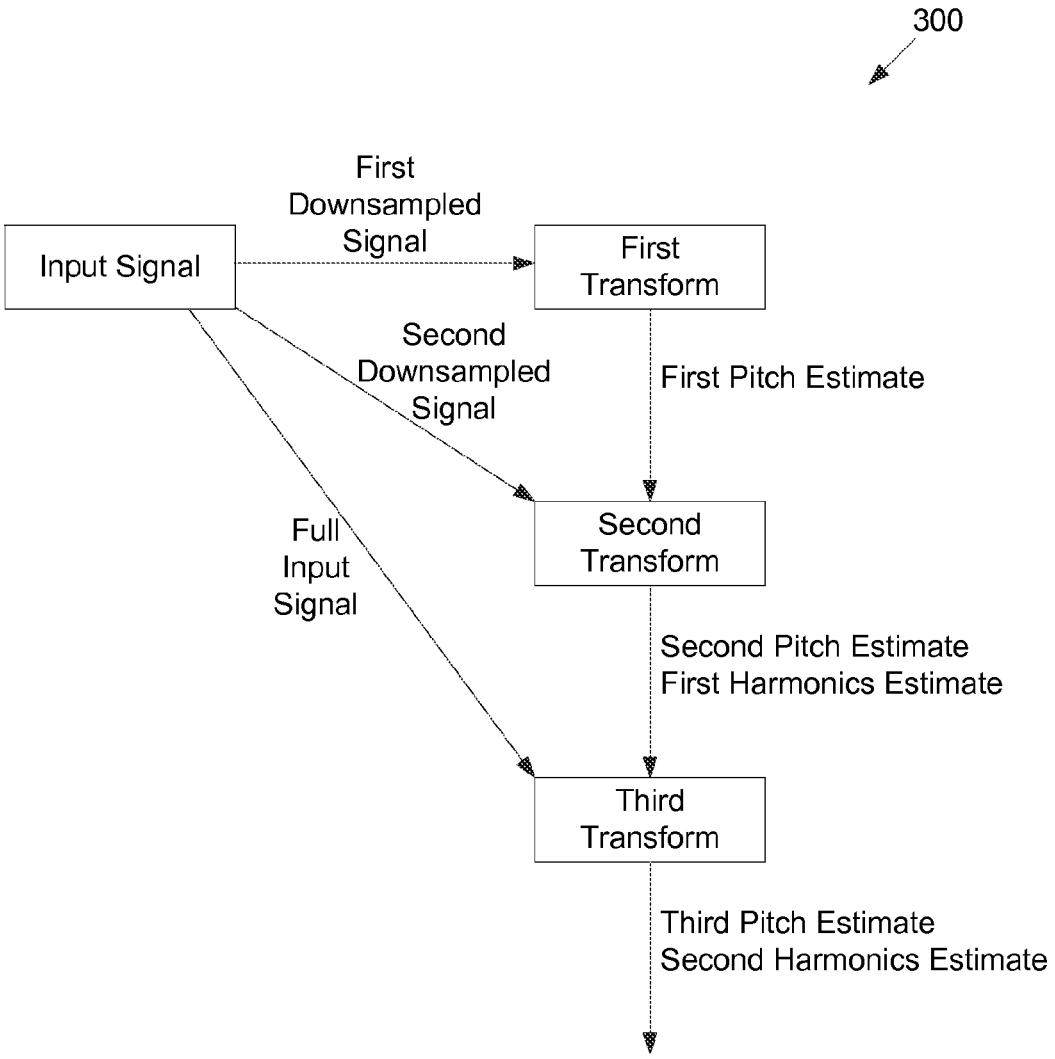
FIG. 3 illustrates a flow of successive transforms performed on signals having varying sampling rates, in accordance with one or more implementations.

In some implementations, the successive transforms performed to obtain a first sound model corresponding to a first time window of input signal 116 may comprise: (1) performing a first transform on the first time window of the first downsampled signal to yield a first pitch estimate; (2) performing a second transform on the first time window of the second downsampled signal to yield a second pitch estimate and a first harmonics estimate based on the first pitch estimate; and (3) performing a third transform on the first time window of the input signal to yield a third pitch estimate and a second harmonics estimate based on the second pitch estimate and the first harmonics estimate. These successive transforms are illustrated by flow 300 in FIG. 3. The first sound model may comprise the third pitch estimate and the second harmonics estimate. In some implementations, the first transform, second transform, and third transform may be the same or similar. According to some implementations, the first transform may be different from the second transform, the second transform may be different from the third transform, and/or the third transform may be different from the first transform. In particular, the transforms may be performed with increasing time and/or frequency resolution.

Turning again to FIG. 1, vocalized speech module 110B may be configured to determine probabilities that portions of the speech component represented by input signal 116 in the individual time windows are vocalized portions or non-vocalized portions. Successive transforms performed by transform module 110A may be performed only on portions having a threshold probability of being a vocalized portion. For example, a portion of the second downsampled signal may be transformed responsive to a corresponding portion of the first downsampled signal being determined to have a threshold-breaching probability of being a vocalized portion. A portion of the input signal may be transformed responsive to a corresponding portion of the second downsampled signal being determined to have a threshold-breaching probability of being a vocalized portion.

The formant model module 110C may be configured to model harmonic amplitudes based on a formant model. Generally speaking, a formant may be described as the spectral resonance peaks of the sound spectrum of the voice. One formant model—the source-filter model—postulates that vocalization in humans occurs via an initial periodic signal produced by the glottis (i.e., the source), which is then modulated by resonances in the vocal and nasal cavities (i.e., the filter). In some implementations, the harmonic amplitudes may be modeled according to the source-filter model as:

$$A_h(t)=A(t)G(g(t),\omega(t))\left[\prod_{r=1}^{N_f}F(f_r(t),\omega(t))\right]R(\omega(t))\Bigg|_{\omega(t)=\phi(t)h},\qquad \text{EQN. 14}$$

where A(t) is a global amplitude scale common to all the harmonics, but time dependent. G characterizes the source as a function of glottal parameters g(t). Glottal parameters g(t) may be a vector of time dependent parameters. In some implementations, G may be the Fourier transform of the glottal pulse. F describes a resonance (e.g., a formant). The various cavities in a vocal tract may generate a number of resonances F that act in series. Individual formants may be characterized by a complex parameter $f_r(t)$. R represents a parameter-independent filter that accounts for the air impedance.

In some implementations, the individual formant resonances may be approximated as single pole transfer functions:

$$F(f(t),\omega(t))=\frac{f(t)f(t)^*}{(j\omega(t)-f(t))(j\omega(t)-f(t)^*)},\qquad \text{EQN. 15}$$

where f(t)=jp(t)+d(t) is a complex function, p(t) is the resonance peak p(t), and d(t) is a dumping coefficient. The fitting of one or more of these functions may be discretized in time in a number of parameters $p^i,d^i$ corresponding to fitting times $t^i$.

According to some implementations, R may be assumed to be R(t)=1−jω(t), which corresponds to a high pass filter.

The Fourier transform of the glottal pulse G may remain fairly constant over time. In some implementations, G=g(t) $gE(g(t))_t$. The frequency profile of G may be approximated in a nonparametric fashion by interpolating across the harmonics frequencies at different times.

Given the model for the harmonic amplitudes set forth in EQN. 9, the model parameters may be regressed using the sum of squares rule as:

$$[A(t),\hat{g}(t),f_r(t)]=\underset{A(t),g(t),f_r(t)}{\operatorname{argmin}}\qquad \text{EQN. 16}$$

$$\left(A_h(t)-A(t)G(g(t),\omega(t))\left[\prod_{r=1}^{N_f}F(f_r(t),\omega(t))\right]R(\omega(t))\Bigg|_{\omega(t)=\phi(t)h}\right)^2$$

-continued

The regression in EQN. 11 may be performed in a nonlinear fashion assuming that the various time dependent functions can be interpolated from a number of discrete points in time. Because the regression in EQN. 11 depends on the estimated pitch, and in turn the estimated pitch depends on the harmonic amplitudes (see, e.g., EQN. 8), it may be possible to iterate between EQN. 11 and EQN. 8 to refine the fit.

In some implementations, the fit of the model parameters may be performed on harmonic amplitudes only, disregarding the phases during the fit. This may make the parameter fitting less sensitive to the phase variation of the real signal and/or the model, and may stabilize the fit. According to one implementation, for example:

$$[A(t), \hat{g}(t), f_r(t)] = \underset{A(t),g(t),f_r(t)}{\operatorname{argmin}} \left( \|A_h(t)\| - \left\| A(t)G(g(t), \omega(t)) \left[ \prod_{r=1}^{N_f} F(f_r(t), \omega(t)) \right] R(\omega(t)) \right\|_{\omega(t)=\phi(t)h} \right)^2. \quad \text{EQN. 17}$$

In accordance with some implementations, the formant estimation may occur according to:

$$[A(t), f_r(t)] = \underset{A(t),f_r(t)}{\operatorname{argmin}} \left[ \sum_h \operatorname{Var}_t \left( \frac{A_h(t)}{A(t) \left[ \prod_{r=1}^{N_f} F(f_r(t), \omega(t)) \right] \Big|_{\omega(t)=\frac{d\Phi}{dt}(t)h}} \right) \right]^2. \quad \text{EQN. 18}$$

EQN. 15 may be extended to include the pitch in one single minimization as:

$$[\Phi(t), A(t), f_r(t)] = \underset{\Phi(t),A(t),f_r(t)}{\operatorname{argmin}} \left[ \sum_h \operatorname{Var}_t \left( \frac{s(t) \backslash M(\Phi(t))}{A(t) \left[ \prod_{r=1}^{N_f} F(f_r(t), \omega(t)) \right] \Big|_{\omega(t)=\frac{d\Phi}{dt}(t)h}} \right) \right]^2. \quad \text{EQN. 19}$$

The minimization may occur on a discretized version of the time-dependent parameter, assuming interpolation among the different time samples of each of them.

The final residual of the fit on the Harmonics amplitudes ($A_h(t)$) for both EQN. 15 and EQN. 16 may be assumed to be the glottal pulse. The glottal pulse may be subject to smoothing (or assumed constant) by taking an average:

$$G(\omega) = E_t(G(\omega, t)) = E_t \left( \frac{A_h(t)}{A(t) \left[ \prod_{r=1}^{N_f} F(f_r(t), \omega) \right] \Big|_{\omega=\frac{d\Phi}{dt}(t)h}} \right). \quad \text{EQN. 20}$$

The reconstruction module 112 may be configured to reconstruct the speech component of input signal 116 with the noise component of input signal 116 being suppressed. The reconstruction may be performed once each of the parameters of the formant model has been determined. The reconstruction may be performed by interpolating all the time-dependent parameters and then resynthesizing the waveform of the speech component of input signal 116 according to:

$$\hat{s}(t) = 2\Re \left( \sum_{h=1}^{N_h} A(t)G(\omega) \left[ \prod_{r=1}^{N_f} F(f_r(t), \omega(t)) \right] R(\omega(t)) \Big|_{\omega(t)=\frac{d\Phi(t)}{dt}h} e^{j\Phi(t)} \right). \quad \text{EQN. 21}$$

The output module 114 may be configured to transmit an output signal 120 to a destination 122. The output signal 120 may include the reconstructed speech component of input signal 116, as determined by EQN. 18. The destination 122 may include a speaker (i.e., an electric-to-acoustic transducer), a remote device, and/or other destination for output signal 120. By way of non-limiting illustration, where communications platform 102 is a mobile communications device, a speaker integrated in the mobile communications device may provide output signal 120 by converting output signal 120 to sound to be heard by a user. As another illustration, output signal 120 may be provided from communications platform 102 to a remote device. The remote device may have its own speaker that converts output signal 120 to sound to be heard by a user of the remote device.

In some implementations, one or more components of system 100 may be operatively linked via one or more electronic communication links. For example, such electronic communication links may be established, at least in part, via a network such as the Internet, a telecommunications network, and/or other networks. It will be appreciated that this is not intended to be limiting, and that the scope of this disclosure includes implementations in which one or more components of system 100 may be operatively linked via some other communication media.

The communications platform 102 may include electronic storage 124, one or more processors 126, and/or other components. The communications platform 102 may include communication lines, or ports to enable the exchange of information with a network and/or other platforms. Illustration of communications platform 102 in FIG. 1 is not intended to be limiting. The communications platform 102 may include a plurality of hardware, software, and/or firmware components operating together to provide the functionality attributed herein to communications platform 102. For example, communications platform 102 may be implemented by two or more communications platforms operating together as communications platform 102. By way of non-limiting example, communications platform 102 may include one or more of a server, desktop computer, a laptop computer, a handheld computer, a NetBook, a Smartphone, a cellular phone, a telephony headset, a gaming console, and/or other communications platforms.

The electronic storage 124 may comprise electronic storage media that electronically stores information. The electronic storage media of electronic storage 124 may include one or both of system storage that is provided integrally (i.e., substantially non-removable) with communications platform 102 and/or removable storage that is removably connectable to communications platform 102 via, for example, a port (e.g., a USB port, a firewire port, etc.) or a drive (e.g., a disk drive, etc.). The electronic storage 124 may include one or more of optically readable storage media (e.g., optical disks, etc.), magnetically readable storage media (e.g., magnetic tape, magnetic hard drive, floppy drive, etc.), electrical charge-based storage media (e.g., EEPROM, RAM, etc.), solid-state storage media (e.g., flash drive, etc.), and/or other electronically readable storage media. The electronic storage 124 may include one or more virtual storage resources (e.g., cloud storage, a virtual private network, and/or other virtual storage resources). The electronic storage 124 may store software algorithms, information determined by processor (s) 126, information received from a remote device, information received from source 118, information to be transmitted to destination 122, and/or other information that enables communications platform 102 to function as described herein.

The processor(s) 126 may be configured to provide information processing capabilities in communications platform 102. As such, processor(s) 126 may include one or more of a digital processor, an analog processor, a digital circuit designed to process information, an analog circuit designed to process information, a state machine, and/or other mechanisms for electronically processing information. Although processor(s) 126 is shown in FIG. 1 as a single entity, this is for illustrative purposes only. In some implementations, processor(s) 126 may include a plurality of processing units. These processing units may be physically located within the same device, or processor(s) 126 may represent processing functionality of a plurality of devices operating in coordination. The processor(s) 126 may be configured to execute modules 104, 106, 108 110A, 110B, 110C, 112, 114, and/or other modules. The processor(s) 126 may be configured to execute modules 104, 106, 108, 110A, 110B, 110C, 112, 114, and/or other modules by software; hardware; firmware; some combination of software, hardware, and/or firmware; and/or other mechanisms for configuring processing capabilities on processor(s) 126.

It should be appreciated that although modules 104, 106, 108, 110A, 110B, 110C, 112, and 114 are illustrated in FIG. 1 as being co-located within a single processing unit, in implementations in which processor(s) 126 includes multiple processing units, one or more of modules 104, 106, 108, 110A, 110B, 110C, 112, and/or 114 may be located remotely from the other modules. The description of the functionality provided by the different modules 104, 106, 108, 110A, 110B, 110C, 112, and/or 114 described below is for illustrative purposes, and is not intended to be limiting, as any of modules 104, 106, 108, 110A, 110B, 110C, 112, and/or 114 may provide more or less functionality than is described. For example, one or more of modules 104, 106, 108, 110A, 110B, 110C, 112, and/or 114 may be eliminated, and some or all of its functionality may be provided by other ones of modules 104, 106, 108, 110A, 110B, 110C, 112, and/or 114. As another example, processor(s) 126 may be configured to execute one or more additional modules that may perform some or all of the functionality attributed below to one of modules 104, 106, 108, 110A, 110B, 110C, 112, and/or 114.

Figure 4:
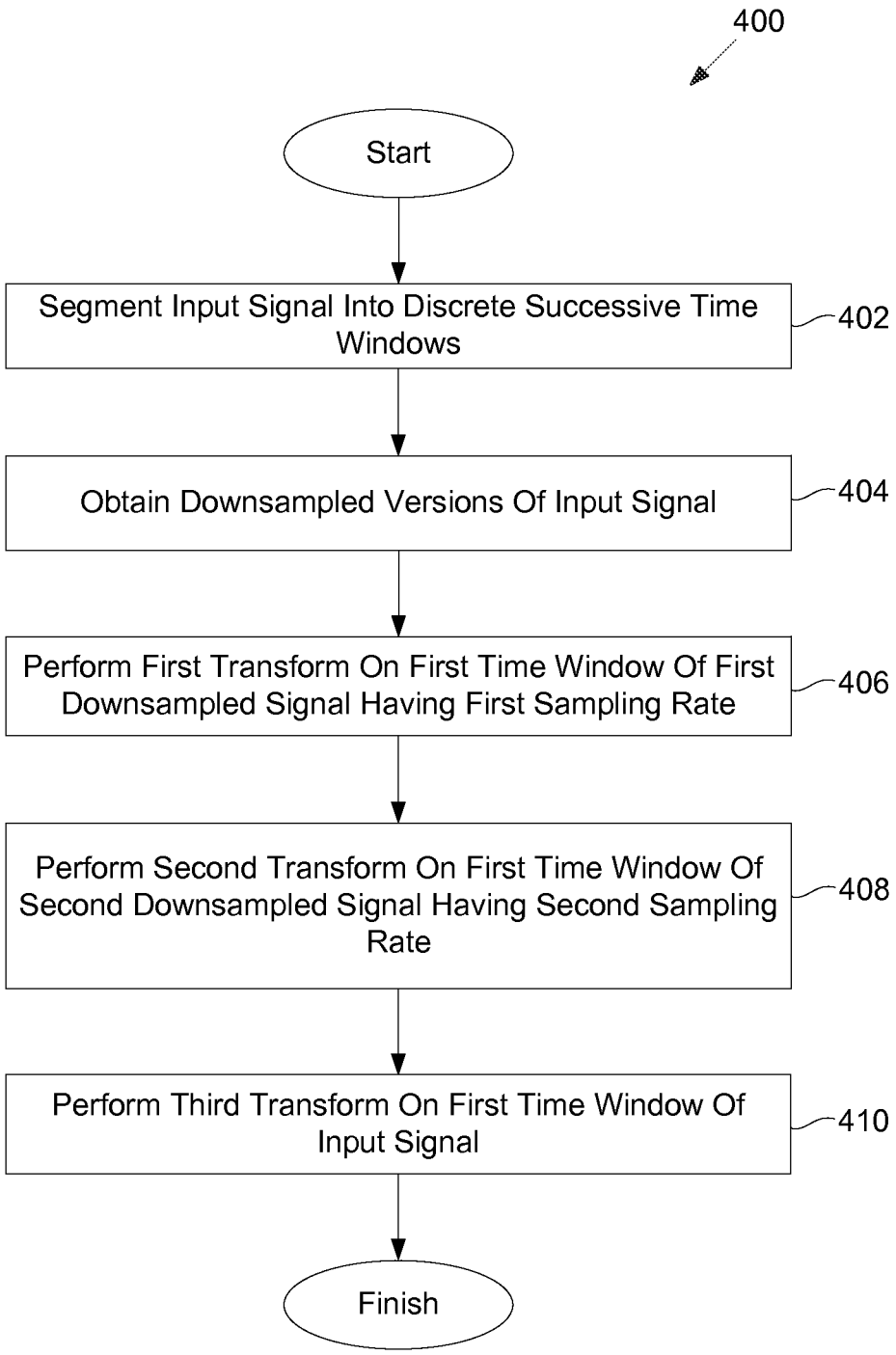
FIG. 4 illustrates a method for performing voice enhancement and/or speech features extraction on noisy audio signals using successively refined transforms, in accordance with one or more implementations.

FIG. 4 illustrates a method 400 for performing voice enhancement and/or speech features extraction on noisy audio signals using successively refined transforms, in accordance with one or more implementations. The operations of method 400 presented below are intended to be illustrative. In some embodiments, method 400 may be accomplished with one or more additional operations not described, and/or without one or more of the operations discussed. Additionally, the order in which the operations of method 400 are illustrated in FIG. 4 and described below is not intended to be limiting.

In some embodiments, method 400 may be implemented in one or more processing devices (e.g., a digital processor, an analog processor, a digital circuit designed to process information, an analog circuit designed to process information, a state machine, and/or other mechanisms for electronically processing information). The one or more processing devices may include one or more devices executing some or all of the operations of method 400 in response to instructions stored electronically on an electronic storage medium. The one or more processing devices may include one or more devices configured through hardware, firmware, and/or software to be specifically designed for execution of one or more of the operations of method 400.

At an operation 402, an input signal may be segmented into discrete successive time windows. The input signal may convey audio comprising a speech component superimposed on a noise component. The time windows may include a first time window. Operation 402 may be performed by one or more processors configured to execute a preprocessing module that is the same as or similar to preprocessing module 106, in accordance with one or more implementations.

At an operation 404, downsampled versions of the input signal may be obtained. The downsampled versions of the input signal may include a first downsampled signal and a second downsampled signal. The first downsampled signal may have a first sampling rate, while the second downsampled signal may have a second sampling rate. The first sampling rate may be less than the second sampling rate. Operation 404 may be performed by one or more processors configured to execute a downsampling module that is the same as or similar to downsampling module 108, in accordance with one or more implementations.

At an operation 406, a first transform may be performed on the first time window of the first downsampled signal to yield a first pitch estimate. Operation 406 may be performed by one or more processors configured to execute a transform module that is the same as or similar to transform module 110A, in accordance with one or more implementations.

At an operation 408, a second transform may be performed on the first time window of the second downsampled signal to yield a second pitch estimate and a first harmonics estimate based on the first pitch estimate. Operation 408 may be performed by one or more processors configured to execute a transform module that is the same as or similar to transform module 110A, in accordance with one or more implementations.

At an operation 410, a third transform may be performed on the first time window of the input signal to yield a third pitch estimate and a second harmonics estimate based on the second pitch estimate and the first harmonics estimate. The first sound model may comprise the third pitch estimate and the second harmonics estimate. Operation 410 may be performed by one or more processors configured to execute a transform module that is the same as or similar to transform module 110A, in accordance with one or more implementations.

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

What is claimed is:

1. A system configured to process an audio signal, the system comprising:

one or more processors configured to execute computer program modules, the computer program modules being configured to:

receive the audio signal obtained from an acoustic-to-electric transducer;

segment the audio signal into discrete successive time windows;

sample the audio signal in a given time window at a first sampling rate to obtain a first downsampled signal of the audio signal in the given time window;

determine that the first downsampled signal has a threshold-breaching probability of being a vocalized portion;

perform a first transform on the first downsampled signal to obtain a first pitch estimate for a speech component in the given time window, wherein the first transform comprises a first linear fit in time of the first downsampled signal with a sound model over the given time window, the sound model being a superposition of harmonics that all share a common pitch and chirp;

sample the audio signal in the given time window at a second sampling rate to obtain a second downsampled signal of the audio signal in the given time window, the first sampling rate being less than the second sampling rate;

determine that the second downsampled signal has the threshold-breaching probability of being a vocalized portion;

responsive to a corresponding portion of the first downsampled signal being determined to have the threshold-breaching probability of being a vocalized portion, perform a second transform on the second downsampled signal to obtain a second pitch estimate and a first harmonics estimate for the speech component in the given time window based on the first pitch estimate wherein the first harmonics estimate comprises a first amplitude estimate or a first phase estimate of a first harmonic, wherein the second transform comprises a second linear fit in time of the second downsampled signal with the sound model over the given time window;

responsive to a corresponding portion of the second downsampled signal being determined to have the threshold-breaching probability of being a vocalized portion, perform a third transform on the audio signal to obtain a third pitch estimate and a second harmonics estimate based on the second pitch estimate and the first harmonics estimate, wherein the second harmonics estimate comprises a second amplitude estimate or a second phase estimate of a second harmonic;

reconstruct the speech component of the audio signal based on the third pitch estimate and the second harmonics estimate and with noise component of the audio signal being suppressed; and synthesize a sound corresponding to the reconstructed speech component, by a speaker, to a user.

2. The system of claim 1, wherein the first sampling rate is half the second sampling rate.

3. The system of claim 1, wherein the first transform is different from the second transform, the second transform is different from the third transform, or the third transform is different from the first transform.

4. The system of claim 1, wherein the first linear fit and the second linear fit are performed by linear regression.

5. The system of claim 1, wherein the common pitch is a time dependent value, and the first, second and third pitch estimates are optimized by nonlinear regression.

6. The system of claim 1, wherein the speaker is integrated in a mobile communication device.

7. A method to process an audio signal, the method comprising:

receiving the audio signal obtained from an acoustic-to-electric transducer;

segmenting the audio signal into discrete successive time windows;

sampling the audio signal in a given time window at a first sampling rate to obtain a first downsampled signal of the audio signal in the given time window;

determining that the first downsampled signal has a threshold-breaching probability of being a vocalized portion;

performing a first transform on the first downsampled signal to obtain a first pitch estimate for a speech component in the given time window, wherein the first transform comprises a first linear fit in time of the first downsampled signal with a sound model over the given time window, the sound model being a superposition of harmonics that all share a common pitch and chirp;

sampling the audio signal in the given time window at a second sampling rate to obtain a second downsampled signal of the audio signal in the given time window, the first sampling rate being less than the second sampling rate;

determining that the second downsampled signal has the threshold-breaching probability of being a vocalized portion;

responsive to a corresponding portion of the first downsampled signal being determined to have the threshold-breaching probability of being a vocalized portion, performing a second transform on the second downsampled signal to obtain a second pitch estimate and a first harmonics estimate for the speech component in the given time window based on the first pitch, wherein the first harmonics estimate comprises a first amplitude estimate or a first phase estimate of a first harmonic, wherein the second transform comprises a second linear fit in time of the second downsampled signal with the sound model over the given time window;

responsive to a corresponding portion of the second downsampled signal being determined to have the threshold-breaching probability of being a vocalized portion, performing a third transform on the-audio signal to obtain a third pitch estimate and a second harmonics estimate based on the second pitch estimate and the first harmonics estimate, wherein the second harmonics estimate comprises a second amplitude estimate or a second phase estimate of a second harmonic;

reconstructing the speech component of the audio signal based on the third pitch estimate and the second harmonics estimate and with noise component of the audio signal being suppressed; and synthesizing a sound corresponding to the reconstructed speech component, by a speaker, to a user.

8. The method of claim 7, wherein the first sampling rate is half the second sampling rate.

9. The method of claim 7, wherein the first transform is different from the second transform, the second transform is different from the third transform, or the third transform is different from the first transform.

10. The method of claim 7, wherein the first linear fit and the second linear fit are performed by linear regression.

11. The method of claim 7, wherein the common pitch is a time dependent value, and the first, second and third pitch estimates are optimized by nonlinear regression.

12. The method of claim 7, wherein the speaker is integrated in a mobile communication device.

13. A non-transitory computer readable storage medium having data stored therein representing computer program instructions to process an audio signal and the instructions when executed by a computer causing the processor to:

receive the audio signal obtained from an acoustic-to-electric transducer;

segment the audio signal into discrete successive time windows;

sample the audio signal in a given time window at a first sampling rate to obtain a first downsampled signal of the audio signal in the given time window;

determine that the first downsampled signal has a threshold-breaching probability of being a vocalized portion;

perform a first transform on the first downsampled signal to obtain a first pitch estimate for a speech component in the given time window, wherein the first transform comprises a first linear fit in time of the first downsampled signal with a sound model over the given time window, the sound model being a superposition of harmonics that all share a common pitch and chirp;

sample the audio signal in the given time window at a second sampling rate to obtain a second downsampled signal of the audio signal in the given time window, the first sampling rate being less than the second sampling rate;

determine that the second downsampled signal has the threshold-breaching probability of being a vocalized portion;

responsive to a corresponding portion of the first downsampled signal being determined to have the threshold-breaching probability of being a vocalized portion, perform a second transform on the second downsampled signal to obtain a second pitch estimate and a first harmonics estimate for the speech component in the given time window based on the first pitch estimate, wherein the first harmonics estimate comprises a first amplitude estimate or a first phase estimate of a first harmonic, wherein the second transform comprises a second linear fit in time of the second downsampled signal with the sound model over the given time window; and responsive to a corresponding portion of the second downsampled signal being determined to have the threshold-breaching probability of being a vocalized portion, perform a third transform on the-audio signal to obtain a third pitch estimate and a second harmonics estimate based on the second pitch estimate and the first harmonics estimate, wherein the second harmonics estimate comprises a second amplitude estimate or a second phase estimate of a second harmonic;

reconstruct the speech component of the audio signal based on the third pitch estimate and the second harmonics estimate and with noise component of the audio signal being suppressed; and synthesize a sound corresponding to the reconstructed speech component, by a speaker, to a user.

14. The non-transitory computer readable storage medium of claim 13, wherein the first sampling rate is half the second sampling rate.

15. The non-transitory computer readable storage medium of claim 13, wherein the first transform is different from the second transform, the second transform is different from the third transform, or the third transform is different from the first transform.

16. The non-transitory computer readable storage medium of claim 13, wherein the first linear fit and the second linear fit are performed by linear regression.

17. The non-transitory computer readable storage medium of claim 13, wherein the common pitch is a time dependent value, and the first, second and third pitch estimates are optimized by nonlinear regression.

18. The non-transitory computer readable storage medium of claim 13, wherein the speaker is integrated in a mobile communication device.

* * * * *